US008210367B2

(12) United States Patent
Nagel et al.

(10) Patent No.: US 8,210,367 B2
(45) Date of Patent: Jul. 3, 2012

(54) WIDTH-ADJUSTABLE PRODUCT DISPLAY TRAY WITH NOVEL MOUNTING ARRANGEMENT

(75) Inventors: Thomas O. Nagel, Blairstown, NJ (US); Joseph F. Kologe, Scranton, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 82 days.

(21) Appl. No.: 12/354,398

(22) Filed: Jan. 15, 2009

(65) Prior Publication Data

US 2010/0176077 A1 Jul. 15, 2010

(51) Int. Cl.
*A47F 5/08* (2006.01)

(52) U.S. Cl. ..... 211/88.02; 211/59.3; 211/126.16

(58) Field of Classification Search ..... 211/59.2, 211/59.3, 15, 51, 88.02, 88.01, 126.15, 126.16, 211/126.5, 132.1, 133.3; 312/60, 61, 71, 312/72, 73; 221/226, 279, 304
See application file for complete search history.

(56) References Cited

U.S. PATENT DOCUMENTS

| | | | | |
|---|---|---|---|---|
| 2,845,187 | A * | 7/1958 | Bianchi | 108/147.17 |
| 3,248,079 | A * | 4/1966 | Kennedy | 248/242 |
| 4,316,546 | A | 2/1982 | Varon et al. | |
| 4,316,547 | A | 2/1982 | Varon | |
| 4,474,299 | A | 10/1984 | Andrews | |
| 5,133,463 | A * | 7/1992 | Merl | 211/190 |
| 5,366,099 | A * | 11/1994 | Schmid | 211/59.3 |
| 5,582,376 | A | 12/1996 | Thompson | |
| 5,665,304 | A * | 9/1997 | Heinen et al. | 312/71 |
| 5,855,283 | A * | 1/1999 | Johnson | 211/59.3 |
| 6,029,833 | A | 2/2000 | Yeh | |
| 6,402,108 | B1 * | 6/2002 | Remmers | 248/243 |
| 6,641,098 | B1 * | 11/2003 | Proffitt | 248/243 |
| 6,745,906 | B1 * | 6/2004 | Nagel | 211/59.3 |
| 6,886,155 | B2 | 4/2005 | Hasha | |
| 6,886,156 | B2 | 4/2005 | McCormack | |
| 7,458,473 | B1 * | 12/2008 | Mason | 211/59.3 |
| 7,681,744 | B2 | 3/2010 | Johnson | |
| 7,690,519 | B2 * | 4/2010 | Kahl et al. | 211/59.2 |
| 2006/0213849 | A1 * | 9/2006 | Bienick | 211/90.02 |

* cited by examiner

*Primary Examiner* — Darnell Jayne
*Assistant Examiner* — Stanton L Krycinski
(74) *Attorney, Agent, or Firm* — St. Onge Steward Johnston & Reens LLC

(57) ABSTRACT

A display tray with a push-forward means for the display of product items in a back to front column, with the forwardmost item of the column being at all times urged tot the front of the tray. A special mounting arrangement is provided for the tray in which product side guides, preferably width adjustable, also serve to mount the trays on a rectangular bar positioned horizontally at the back of a display gondola or the like, enabling a plurality of such trays to be mounted side by side and movable laterally for desired spacing and appearance. To particular advantage, the side guides are formed of a rigid sheet material, typically sheet metal, provided at front and back portions with transverse mounting rods engageable with base members of the tray to accommodate lateral adjustment of the side guides relative to the central portions of the tray.

4 Claims, 3 Drawing Sheets

WIDTH-ADJUSTABLE PRODUCT DISPLAY TRAY WITH NOVEL MOUNTING ARRANGEMENT

BACKGROUND OF THE INVENTION

In connection with the in-store display of small product items, it is a common practice to provide display trays arranged to receive a plurality of product items in a front-to-back column, with a spring actuated pusher arrangement at the back of the column for automatically moving the product column forward each time a product is removed from the front of the display. This provides a more sales-attractive display by keeping the merchandise always available at the front of the display where it is easily seen and easily removed.

Inasmuch as products sold in such displays come in various sizes and shapes, it is typical to provide for width-adjustability of the trays to accommodate different types of products. Advantageous forms of display trays of this type are shown in U.S. Pat. Nos. 6,745,906, 6,866,155, 6,886,700, 6,889,855, and 7,032,761, owned by Trion Industries, Inc., assignee of this invention. The disclosures of these patents are incorporated herein by reference.

Storeowners are presented with a wide variety of environments for the display of merchandise. Some are displayed on shelves, others are supported from panels or supports on gondolas, etc. It is desirable to enable such merchandisers to accommodate as many display circumstances as practicable with a modular display system that can readily be adapted to the particular circumstances in which the display is to be presented. Historically, this has required the merchandisers to invest in and maintain a wide variety of different display systems, which represents significant cost and inconvenience to the merchandiser.

SUMMARY OF INVENTION

The present invention is directed to an improved form of product display tray of the type having adjustable side guides and a spring actuated pusher arrangement, in which basic components of the tray can be of standardized design with specific modifications to enable the tray to be supported at its back end by means of a gondola-mounted display bar. The arrangement greatly facilitates positioning and adjustment of the trays in an overall display arrangement, and allows for the desired width adjustment of the tray to accommodate different sized products.

The display tray of the invention is adapted and intended for mounting on a display bar of the general type illustrated in U.S. Pat. No. 7,438,628, by way of example. Pursuant to the invention, the adjustable side guides of the tray, typically formed of wire, are formed of panels of rigid sheet material, preferably sheet metal. The panels are formed at the back end with downwardly opening, shaped recesses configured to fit closely over the cross section of a mounting bar of the type mentioned above, which serves to support the display tray in an outwardly projecting, cantilever fashion. The arrangement is such that the tray may be easily and quickly placed on the mounting bar and may be laterally positioned thereon by simply sliding the tray to one side or the other. The side guide panels, which serve to mount the tray, can be readily adjusted widthwise, with respect to the central portions of the tray, to accommodate different products.

For a more complete understanding of the above and other features and advantages of the invention, reference should be made to the following detailed description of a preferred embodiment thereof, and to the accompanying drawings.

DESCRIPTION OF A PREFERRED EMBODIMENT

Figure 1:
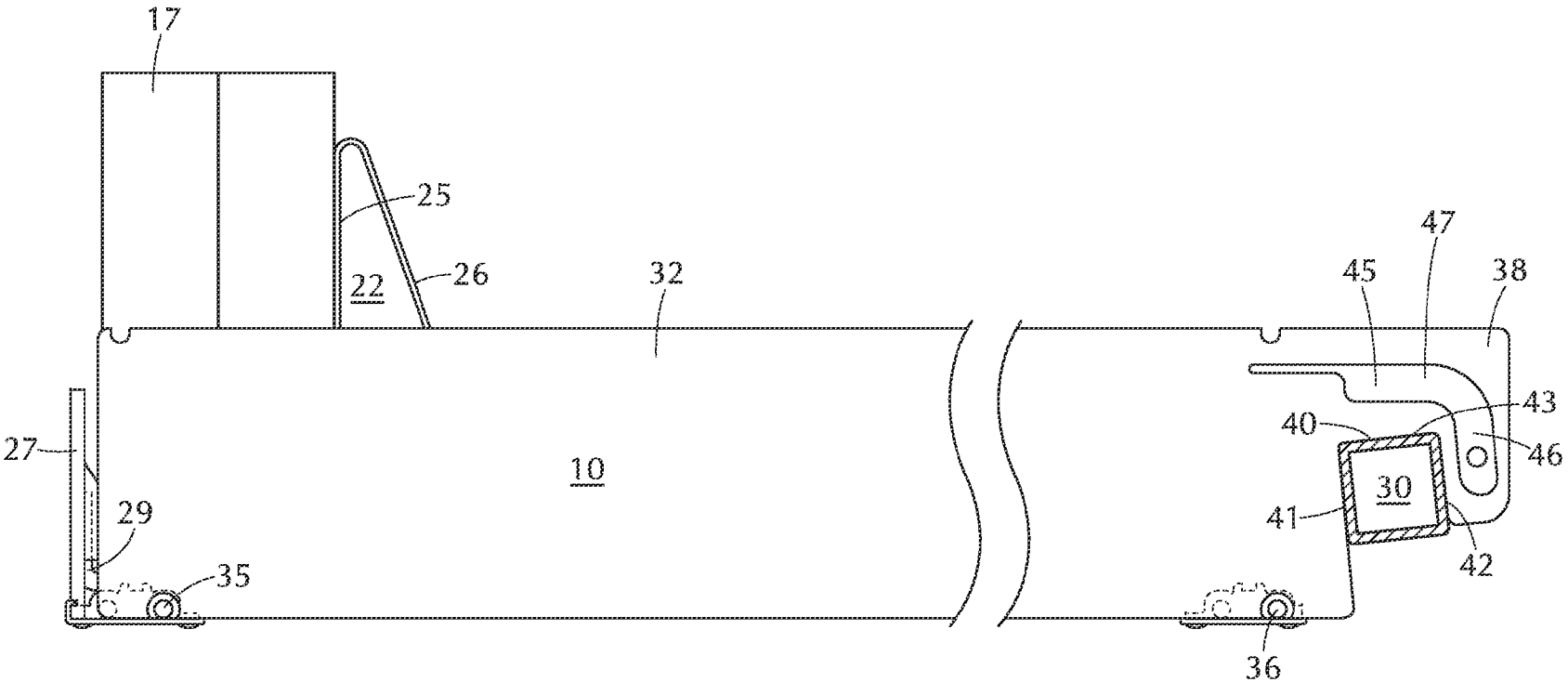
FIG. 1 is a side elevational view of a product display tray incorporating the features of the invention.

Referring now to the drawings, the reference numeral 10 designates generally a product display tray of the general type referred to in the before mentioned patents. The tray 10 includes a base structure which is advantageously in the form of a plurality of longitudinally extending wires 11-14, rigidly connected at the front and back to cross bars 15, 16. The longitudinal wires 11-14 and cross bars 15, 16 form a rigid base structure for the slideable support of display products 17. Front and back base members 18, 19, advantageously formed of plastic material, are formed with upwardly facing grooves 20, 21 for the snap-in reception of the cross bars 15, 16 respectively. A pusher element 22 is slideably engaged with the longitudinal wires 11-14 and is constantly urged forwardly by a coil spring element 23, the coiled portion 24 of which is contained between front and back walls 25, 26 of the pusher element.

Typically, the tray 10 is provided with a front barrier panel 27, which may be mounted on upturned front end portions 28, 29 of the outer base wire elements 11, 14. The barrier 27 serves as a front stop for the packages 17, and also to provide for product identification and pricing.

The construction of the tray 10 as thus far described is known from the patents previously mentioned. Additionally, it is conventional to provide such trays with side guides at each side for lateral confinement of products supported on the base structure. Typically, such side guides are formed of wire, with front and back elements of the wire extending transversely and received in transverse passages (not shown) in the base members 18, 19. Such an arrangement is described in, for example, the before mentioned Nagel U.S. Pat. No. 6,886,700.

Figure 2:
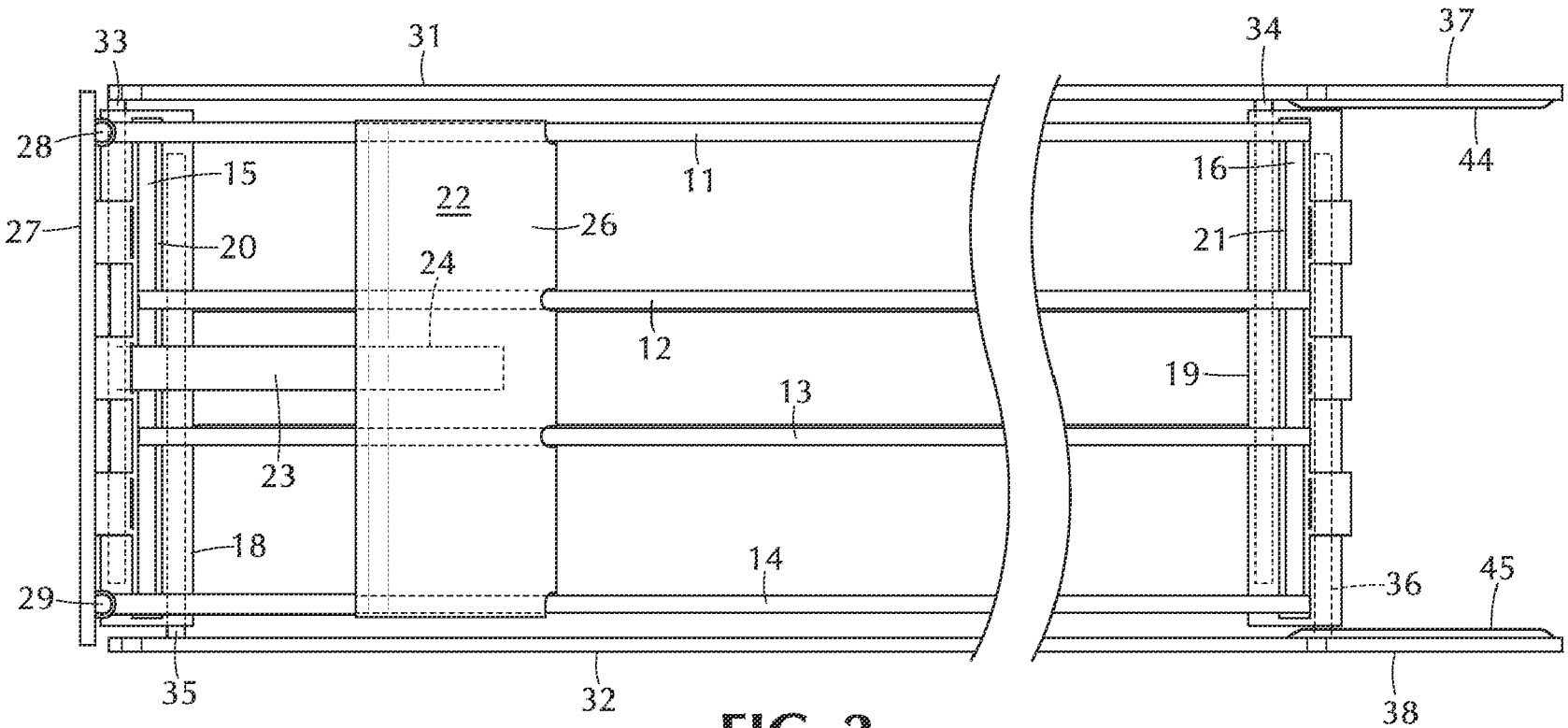
FIG. 2 is a top plan view of the tray of FIG. 1.
Figure 3:
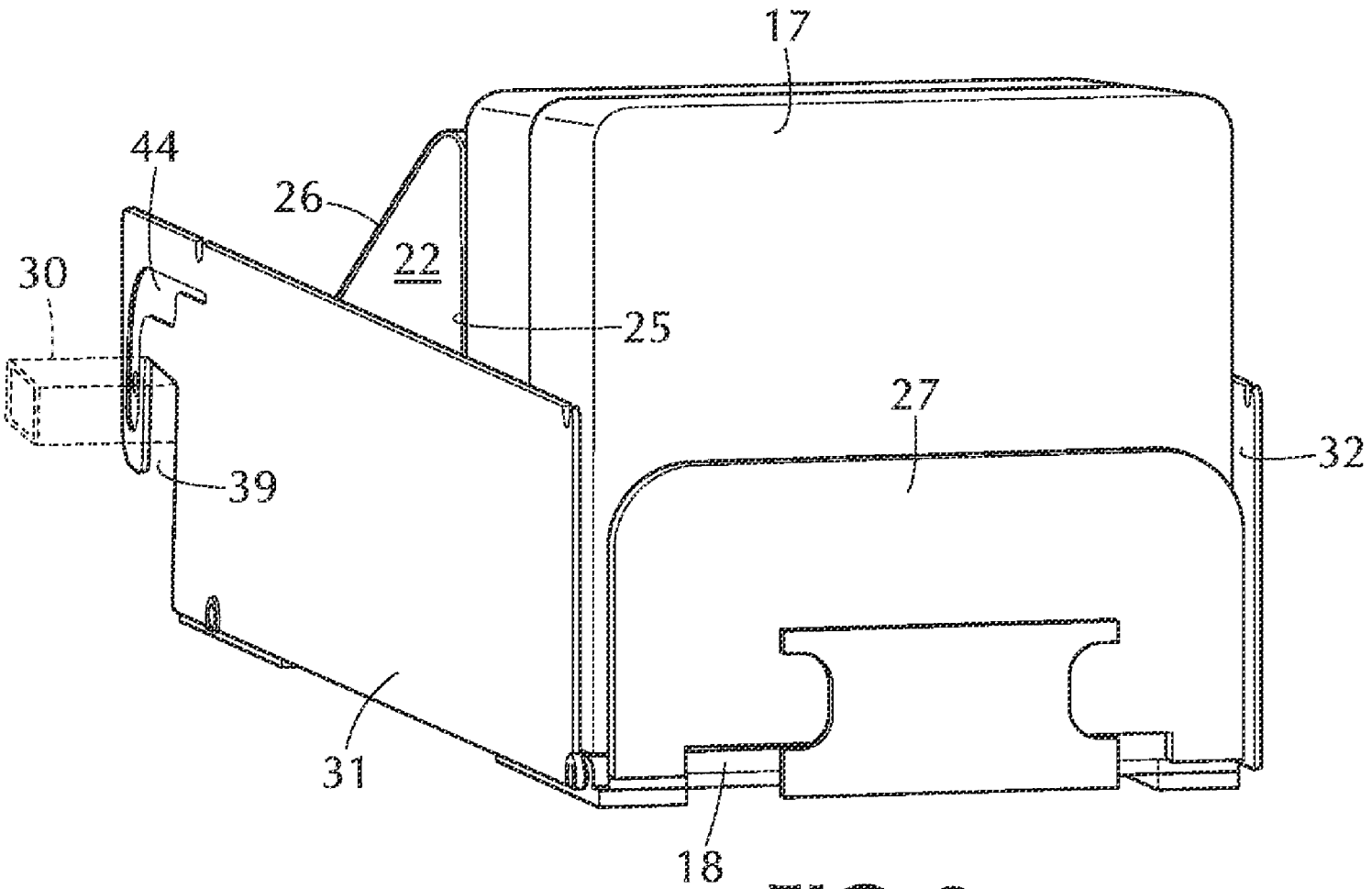
FIG. 3 is a front perspective view of the tray of FIG. 1.

Pursuant to the present invention, the tray is arranged to be mounted in cantilever fashion on a rectangular mounting bar 30 (FIG. 1). The mounting bar 30 itself is mounted to the structure of a merchandising gondola or other structure, as described for example, in the before mentioned U.S. Pat. No. 7,438,268. In the tray structure of the invention, side guides 31, 32 provided at opposite sides of the unit are formed of panels of rigid sheet material, preferably a sheet metal material. The sheet metal may be generally flat, but also may be provided where appropriate with ribs or the like for stiffening and strengthening. Each of the side panels 31, 32 is joined at front and back portions thereof with transversely disposed mounting wires 33, 34 (for the panel 31) and 35, 36 (for the panel 32). Preferably, these wires 33-36 are welded to lower edge portions of the panels 31, 32, and more preferably, the ends of the wires are welded directly to the inner surfaces of the panels. The transverse wires 33-36 are arranged, as shown in FIG. 2, to be received within transverse recesses (not specifically shown) formed in the plastic base members 18, 19. When the transverse wires are fully inserted in these transverse recesses, the side guide panels 31, 32 will be in their minimum width positions, as shown in FIG. 2. To accommodate products of greater width, one or both of the panels 31, 32 may be drawn laterally outward with respect to the base structure. Rather extensive width adjustment is accommodated, so long as the transverse wires 33-36 remain adequately engaged within the recesses of the base elements 18, 19.

As shown in FIG. 2, the transverse wires 33, 34 of the side panel 31 are offset somewhat forwardly with respect to the transverse wires 35, 36 of the opposite side guide 32 to accommodate for the offset spacing of the transverse passages in the base members 18, 19. By offsetting the mounting of the transverse wires, the side guide panels 31, 32 themselves can be uniformly and symmetrically positioned relative to the base structure.

Pursuant to the invention, the side guide panels 31, 32 have rearward extensions 37, 38 which preferably project beyond of the back base member 19. Each of these extensions is formed with a downwardly opening notch 39, 40 formed with parallel sides 41, 42 and a flat upper portion 43 connecting the flat sides 41, 42. The notch is dimensioned to closely fit over the mounting bar 30, as reflected in FIG. 1 such that, when the side panels are positioned on the mounting bar, the tray extends forwardly from the mounting bar in cantilever fashion. The mounting bar itself is rigidly (i.e., non-rotatably) mounted to its gondola or other structure.

Inasmuch as the cantilever mounting of the trays 10 can impose significant loading on the back extensions 37, 38 of the side panels, it is beneficial to form strengthening ribs 45 in the extensions, in the immediate region of the notches 39, 40. The strengthening ribs may be formed by lateral displacement or shaping of the panel material. In the illustrated arrangement, such a displacement is provided in the shape of an inverted "L", with a portion 46 extending downward behind the notches and a portion 47 extending forwardly above the notches.

The adjustable side panels provide a unique and economical way for mounting of display trays on horizontal mounting bars. The trays may be easily placed on and/or removed from the mounting bars and may be readily positioned and repositioned laterally along the bars as needed. For refilling of the tray, it can, if desired, be simply lifted off its mounting bar, refilled at a convenient location, and replaced. Likewise, the side panels 31, 32 can be set at any width, within the range of the device, without in any way affecting the manner in which the tray is positioned on and removed from the mounting bar.

The use of the adjustable side panels enables the basic tray unit, consisting of the base structure, pusher, spring, etc. to be readily adapted for bar mounting. Thus, the same basic unit can accommodate bar mounting or shelf mounting by simply substituting the side panels 31 for more conventional wire side guides. This greatly simplifies the requirements of the storekeeper in terms of inventory of display devices and the convenience of their use. Moreover, the display unit incorporating side panels as illustrated can also be presented as a shelf-mounted unit by simply supporting its base members 18, 19 on a display shelf. In the latter case, the rearward extensions of the side panels would not be functionally utilized. The bottoms of the base members 18, 19, which project slightly below the bottom edges of the side guide panels 32, 32, as shown in FIG. 1, define a support level for the tray when it is mounted on a shelf.

As shown in FIG. 1, the lower edges of the side panels 31, 32 are positioned to be slightly above the bottom surfaces of the base members 18, 19. Thus, when the tray is supported on a display shelf, the rearward extensions 37, 38 of the side panels, in which the bar-receiving recesses 39, 40 are formed, are positioned at or above the support level referred to above and enable the tray and its base structure to be properly supported on a display shelf.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

The invention claimed is:

1. A tray for the display of articles of merchandise, and of the type which comprises (a) a base structure for supporting a plurality of articles of merchandise in a front-to-back column, said base structure having front and back ends and top and bottom portions, (b) a barrier element at the front end of said base structure serving to limit forward movement of a forwardmost article of merchandise in a column thereof, (c) a product pusher slideably mounted on said base structure and resiliently urged in a forward direction to urge the articles of merchandise forwardly, and (d) laterally adjustable side guides attached to said base structure and positioned at each lateral side thereof for lateral confinement of said articles of merchandise, and (e) said laterally adjustable side guides having spaced apart front and back mounting elements extending laterally inward therefrom adjustably engaging said base structure, characterized by (f) the laterally adjustable side guides being formed of generally flat plates of sheet metal, oriented in generally vertical planes, and extending substantially over a full length of said base structure to provide lateral confinement of a plurality of products of like but variable width supported on said base structure in a front-to-back column, (g) said front and back mounting elements extending laterally from lower edge portions of said side guides into engagement with spaced apart front and back portions of said base structure, (i) said laterally adjustable side guides having forward portions positioned for lateral product confinement and rearward extensions extending rearwardly of said forward portions, and (i) said rearward extensions each being provided with a bar-receiving recess configured and dimensioned for the close reception and confinement of a rectangular merchandise support bar, whereby said tray can be removably supported on such a merchandise support bar in a forwardly projecting, laterally repositionable cantilever fashion by means of said side guides, (j) said side guides and said merchandise bar constituting the exclusive means of supporting the base structure.

2. The tray of claim 1, wherein, (a) said bar-receiving recesses are located in said rearward extensions at a level above the bottom portions of said base structure.

3. The tray of claim 2, wherein (a) said side guides are of generally rectangular configuration and have top and bottom edges, and (b) said bar-receiving recesses are so positioned with respect to said top and bottom edges that, when said tray is mounted on a merchandise support bar, the bar is positioned at a level above the bottom portions of the base structure.

4. The tray of claim 1, wherein (a) said base structure comprises a plurality of laterally spaced apart, longitudinally extending wire elements, for supporting articles of merchandise, and longitudinally spaced apart front and back base supports extending laterally underneath and supporting said wire elements, and (b) said front and back mounting elements are adjustably received in the respective front and back base supports.

* * * * *